United States Patent [19]

Kutz

[11] 4,224,812

[45] Sep. 30, 1980

[54] WASHING APPARATUS

[75] Inventor: Johannes Kutz, St. Tönis near Krefeld, Fed. Rep. of Germany

[73] Assignee: Eduard Küsters, Krefeld, Fed. Rep. of Germany

[21] Appl. No.: 926,624

[22] Filed: Jul. 21, 1978

[30] Foreign Application Priority Data

Aug. 13, 1977 [DE] Fed. Rep. of Germany ..... 2736604

[51] Int. Cl.[2] ..... D06B 1/02

[52] U.S. Cl. ..... 68/205 R; 68/62; 68/DIG. 5

[58] Field of Search ..... 68/205 R, 62, DIG. 5

[56] References Cited

U.S. PATENT DOCUMENTS

| | | | |
|---|---|---|---|
| 3,686,903 | 8/1972 | Fleissner | 68/DIG. 5 |
| 4,056,954 | 11/1977 | Meier-Windhorst | 68/205 R X |
| 4,068,501 | 1/1978 | Aronoff et al. | 68/205 R X |

FOREIGN PATENT DOCUMENTS

| | | | |
|---|---|---|---|
| 2334998 | 1/1975 | Fed. Rep. of Germany | 68/205 R |

*Primary Examiner*—Philip H. Coe
*Attorney, Agent, or Firm*—Kenyon & Kenyon

[57] ABSTRACT

In washing apparatus for continuously running webs of material which includes at least two drums arranged in a housing one above the other, around which the web of material is looped; at least one slit nozzle arranged beside the upper drum aimed toward the upper drum from the outside and extending over the width of the web of material, by means of which a flat water jet can be directed toward the web of material looped around the drum; and baffles arranged in the housing for conducting away the mass of water flowing down on the web of material after impingement, the web of material covers the upper portion of the lower drum in one looping zone and a baffle is disposed at the height of this zone beside the lower drum in such a manner that the water wave falling down from the point of impingement at the upper drum and impacting on the baffle is conducted toward the web of material in the looping region of the lower drum.

5 Claims, 1 Drawing Figure

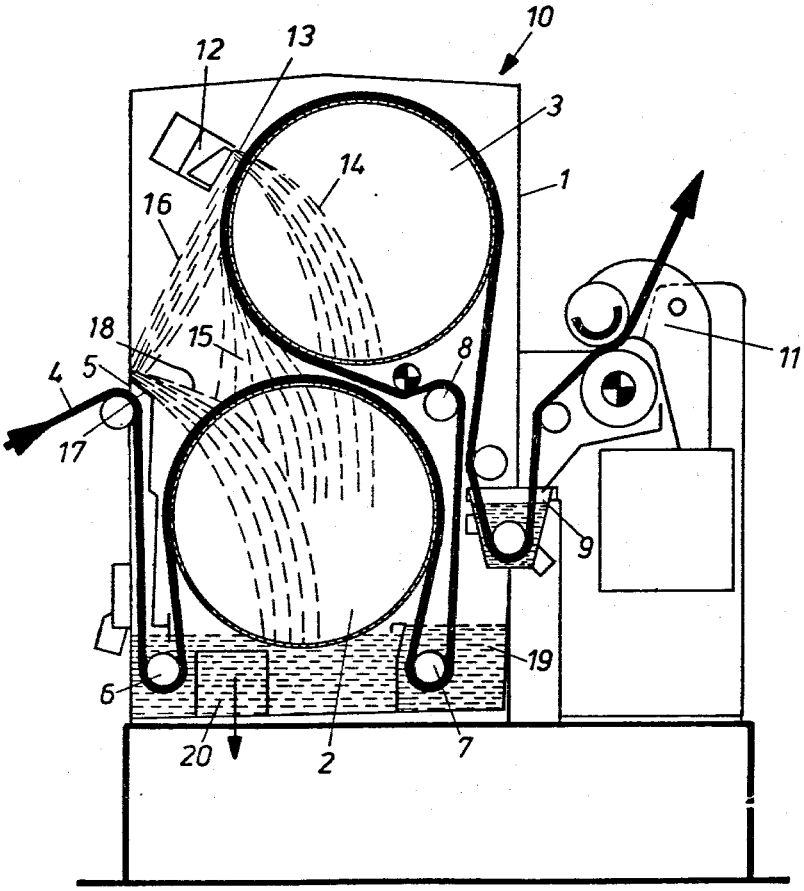
10
12
13
3
14
1
16
18
15
8
11
4
5
17
9
19
6
20
2
7

WASHING APPARATUS

BACKGROUND OF THE INVENTION

This invention relates to washing apparatus for continuously running webs of material in general and more particularly to more efficient apparatus of this type.

Washing apparatus which includes at least two drums arranged in a housing on top of each other and around which the web of material is looped, and at least one slit nozzle arranged next to the upper drum and aimed against the upper drum and aimed from the outside are known. The slit nozzle extends over the width of the web of material, and permits a flat water jet to be directed against the web of material looped around the drum. Baffles are arranged in the housing for conducting away the masses of water which flow down after striking the web of material. Washing apparatus of this type is known from the German Offenlegungsschrift No. 23 34 998. In the known apparatus, the baffles serve for collecting the outflowing mass of water and to return it to the pump loop. The water therefore performs a washing action only once as it passes through.

SUMMARY OF THE INVENTION

It is an object of the present invention to improve the effectiveness of the washing apparatus of the afore-mentioned type.

To solve this problem, according to the invention, the web of material is arranged to cover the upper portion of the lower drum in a looping zone where it is looped around the drum and a baffle is arranged beside the lower drum at the height of the zone in such a manner that the water wave descending from the point of impingement on the upper drum and striking the baffle is conducted toward the web of material in the looping zone of the lower drum.

In this manner, the water masses which have been set in motion, and in which considerably kinetic energy resides, can be put to work for washing a second time without spending more pump power, by conducting them not only directly through the slit nozzle, but also, by means of the baffle, against the web of material, namely, at the lower drum. Practical experience shows that a distinct improvement of the washing effect can be achieved by this simple measure and that the thickened layer which surrounds the fiber and otherwise may cause difficulties, can be broken up and washed off without trouble.

In one practical embodiment, the baffle is designed as a step of the housing wall and is directed at an angle downward toward the lower drum.

In one advantageous way of conducting the web of material, deflection rollers are arranged on both sides below the lower drum. The web of material is conducted by the deflection roller located on the side of the slit nozzle up over the lower drum and down again to the deflection roller located on the other side. From there, it runs up and through the space between the drums to the side of the upper drum opposite the slit nozzle.

In this arrangement, the web of material is presented to the water descending from the impingement point first on the side of the slit nozzle and a second time below the same.

So that the water descending from the upper drum gets to the lower drum as completely as possible, it is advisable that the upper drum be shifted horizontally relative to the lower drum in a direction toward the side facing away from the slit nozzle.

BRIEF DESCRIPTION OF THE DRAWING

The single FIGURE is a diagrammatic view of apparatus according to the present invention.

DETAILED DESCRIPTION OF THE INVENTION

The washing apparatus 10 of the present invention comprises a housing 1, in which a lower screen drum 2 and an upper screen drum 3 are supported in bearings one above the other. A web of material 4 runs into the housing at an entrance 5 and is looped around deflection roller 6 which is arranged on the left in the drawing below the lower drum 2, then proceeds upwards over the lower drum 2 and is looped on the other side around a deflection roller 7 likewise arranged below the lower drum 2; from there it runs through the space between the lower drum 2 and the upper drum 3 again to the left side of the upper drum 3 and is looped around the latter. The web of material 4 then leaves the washing apparatus 10 at a water lock 9 and is squeezed out in a following squeezing mechanism 11.

At the side of the upper drum 3, is a slit nozzle 12, which extends over the entire width of the web of material 4, and from which a flat water jet 13, carrying a large quantity of water is directed toward the web of material, which is looped around and supported by the upper drum 3.

A part of the water jet 13 penetrates the web of material 4 and the drum 3 getting into the interior of the drum 3 if the web of material is permeable. The washing method, however, is also suitable for other webs of material. Another part 15 runs down on the outside of the drum 3 and then falls freely onto the web of material 4 advancing in the upper portion of the lower drum 2, producing an additional washing effect there. To aid in this, the upper drum 3 is shifted horizontally relative to the lower drum 2 in a direction toward the side facing away from the slit nozzle 12.

A substantial part 16 of the water wave 13, however, is flung away, under the force of the impact, from the point of impact on the drum 3 and strikes the wall of the housing 1, especially the baffle 17 which is arranged at the height of the upper portion of the drum 2 next to the latter and which is designed as a step in the housing wall and is inclined at an angle downward toward the drum 2. The water wave 16 is transformed by the baffle into a further water wave 18, which strikes the web of material running over the lower drum at its upper portion. The water wave 18 still has a considerable amount of kinetic energy, so that it is capable of again developing a washing effect. The horizontal offset of the drums 2 and 3 permits bringing the lower drum 2 close to the wall containing the baffle 17 in order to promote the effect. No reflection in the proper sense takes place at the baffle 17 and the baffle therefore need not be arranged, for instance, at an angle determined by the law of reflection. The baffle 17, rather, is intended mainly to deflect the water jet 16 and is therefore designed and arranged so that the water jet 16 is changed into the water jet 18 directed toward the drum 2 with a minimum of loss.

The falling quantities of water are finally collected in a sump 19 in the lower portion of the housing 1, drained off via a canal 20 and returned to the pump and therewith, to the slit nozzle 12.

What is claimed is:

1. In washing apparatus for continuously running webs of a material which includes:

(a) a housing;

(b) at least two drums, arranged in said housing one substantially vertically above the other with a space therebetween, with a web of material running through said housing and being looped around said two drums; and (c) at least one slit nozzle disposed within said housing opposite the upper drum and on one side of said upper drum, said slit nozzle being aimed toward said upper drum and extending over the width of the web of material, by means of which a flat water jet is directed toward the web of material looped around said upper drum, said flat water jet impinging against said web of material looped around said upper drum with at least some of said water reflected away from said upper drum in a wave, said jet directed so that the reflected water flows at least partially downward, the improvement comprising:

(d) means for conducting the web of material about said drums so that it covers the upper portion of the lower drum in one looping region, and (e) a baffle disposed at the height of said looping region on one side of the lower drum, which one side of the lower drum corresponds to the one side of the upper drum, at a position and an angle such that the reflected water wave will impact on said baffle and be reflected by said baffle toward the web of material in said looping region of the lower drum.

2. The improvement according to claim 1, wherein said baffle comprises a step of the wall of the housing directed downward at an angle toward the lower drum.

3. The improvement according to one of the claims 1 or 2, wherein said upper drum is shifted horizontally relative to the lower drum toward the side away from said slit nozzle.

4. The improvement according to claim 1, wherein said means for conducting include deflection rollers disposed on both sides of and below said lower drum and wherein the web of material is conducted upwards from the deflection roller which is located on the side of the lower drum where the baffle is disposed, over the lower drum, down again to the other deflection roller, and from there upwards and through the space between the drums to the side of the upper drum opposite said slit nozzle.

5. The improvement according to claim 4, wherein said upper drum is shifted horizontally relative to the lower drum toward the side away from said slit nozzle.

* * * * *